US005666786A

United States Patent [19]

Focke et al.

[11] Patent Number: 5,666,786

[45] Date of Patent: Sep. 16, 1997

[54] PROCESS AND APPARATUS FOR INTRODUCING COMPRESSIBLE PACKS INTO A CONTAINER

[75] Inventors: Heinz Focke, Verden; Harald Freudenberg, Marklohe, both of Germany

[73] Assignee: Focke & Co. (GmbH & Co.), Germany

[21] Appl. No.: 534,396

[22] Filed: Sep. 27, 1995

[30] Foreign Application Priority Data

Sep. 29, 1994 [DE] Germany ..... 44 34 866.5

[51] Int. Cl.[6] ..... B65B 31/00

[52] U.S. Cl. ..... 53/434; 53/448; 53/446; 53/438; 53/527; 53/529; 53/512; 53/539; 53/544; 53/247

[58] Field of Search ..... 53/434, 438, 436, 53/527, 528, 529, 539, 544, 247, 446, 510, 526

[56] References Cited

U.S. PATENT DOCUMENTS 3,382,643 5/1968 Hullhorst et al. .

FOREIGN PATENT DOCUMENTS 0576956 1/1994 European Pat. Off. .
2363030 7/1975 Germany .
2542722 6/1976 Germany .
2610269 9/1976 Germany .
2532297 1/1977 Germany .
2744158 5/1978 Germany .
3906634 9/1990 Germany .
4005541 8/1991 Germany .
4243764 6/1994 Germany .
2200093 7/1988 United Kingdom .

*Primary Examiner*—John Sipos
*Assistant Examiner*—John Paradiso
*Attorney, Agent, or Firm*—Rothwell, Figg, Ernst & Kurz, P.C.

[57] ABSTRACT

Process and apparatus for introducing compressible packs, especially bundles (10) or bundle groups (16, 17) comprised of small packs (11) of paper tissues into a carton (15). Articles or packs or pack groups of cellulose products are difficult to handle from the point of view of packaging technology. For the introduction into a carton (15) open at the top, bundle groups (16, 17) consisting of a multitude of small packs (11) of paper tissues are mechanically compressed, especially into a V-shaped form, then grasped on the top side by a lifting head (23) with suction holders (24 to 27) and held by suction. The lifting head (23) conveys a complete layer of bundle groups (16, 17) into the carton (15) from above, the compressed, reduced formation of the bundles (10) being maintained until they are deposited in the carton (15).

13 Claims, 7 Drawing Sheets

PROCESS AND APPARATUS FOR INTRODUCING COMPRESSIBLE PACKS INTO A CONTAINER

DESCRIPTION

The invention relates to a process for introducing articles made of compressible, air-permeable material, especially cellulose, preferably groups of packs or pack bundles—bundle groups—with paper tissues, into large containers, such as cartons. The invention furthermore relates to an apparatus for carrying out the process according to the invention.

The handling of soft, resilient articles, especially articles made of cellulose, such as paper tissues, napkins, etc. in packaging technology poses particular problems in a mechanized sequence of working cycles. The invention relates to the introduction of such articles into large containers, specifically cartons. To be precise, the invention relates to the filling of large-volume cartons with groups of small packs for paper tissues which are combined to form a bundle. The small packs which each comprise a plurality of folded paper tissues are normally offered in bundles of ten, twelve or more small packs. The bundle is surrounded by a wrapping of foil or the like. The carton serves for receiving a multitude of such bundles. A plurality of bundles are arranged in a layer, and a plurality of layers are arranged on top of one another in the carton. The carton also serves for the presentation and sale of the bundles in discount department stores. Hitherto it has been usual to fill the bundles in layers into such cartons by hand.

The invention is based on the object to introduce soft, resilient, and air-permeable articles into containers, especially to fill bundles of paper tissues into cartons mechanically, without damaging the goods to be packaged.

To attain this object, the process according to the invention is characterized in that the articles or (bundle) packs are deaerated, thereby reducing the outer dimensions, and then, while maintaining the reduced dimensions, are introduced into the container, and in that the articles, after having been deposited in the container, entirely or almost entirely assume their original volume.

The invention benefit's from the compressibility, but especially from the air permeability of the articles. The outer dimensions of the articles or the bundle group which is to be introduced into the container as a unit are reduced by deairing or evacuation, so that the filling of the container, which is adapted to the outer dimensions of the articles, is facilitated. After depositing the article in the container, the article fills with air again so that the original volume is entirely or almost entirely assumed.

The air is preferably removed from the article by suction in conjunction with the application of pressure. An embodiment according to the invention in which lifting means with a suction head are employed for the handling of the bundle groups is particularly advantageous. The suction head grasps the bundles on their top side. As a result of the vacuum in the region of the suction head, the air is partly removed from the bundles so that the volume is reduced.

Preferably, the bundles are compressed by mechanical compression before they are picked up by the suction head, specifically by means of a pressure device which acts upon the sides of the bundle, so that air is removed and the volume is reduced. The bundles are picked up by the suction head and introduced into the container in this predetermined compressed formation with a preferably V-shaped cross-section.

According to the invention, the pressure device and the lifting member with suction head are configured in a special manner. Especially the suction head is equipped with a plurality, preferably four holding members for each group of bundles, such that a complete layer of bundles can be introduced into the container in one working cycle.

Further details of the invention will be explained hereinbelow with reference to exemplary embodiments. In these:

Figure 1:
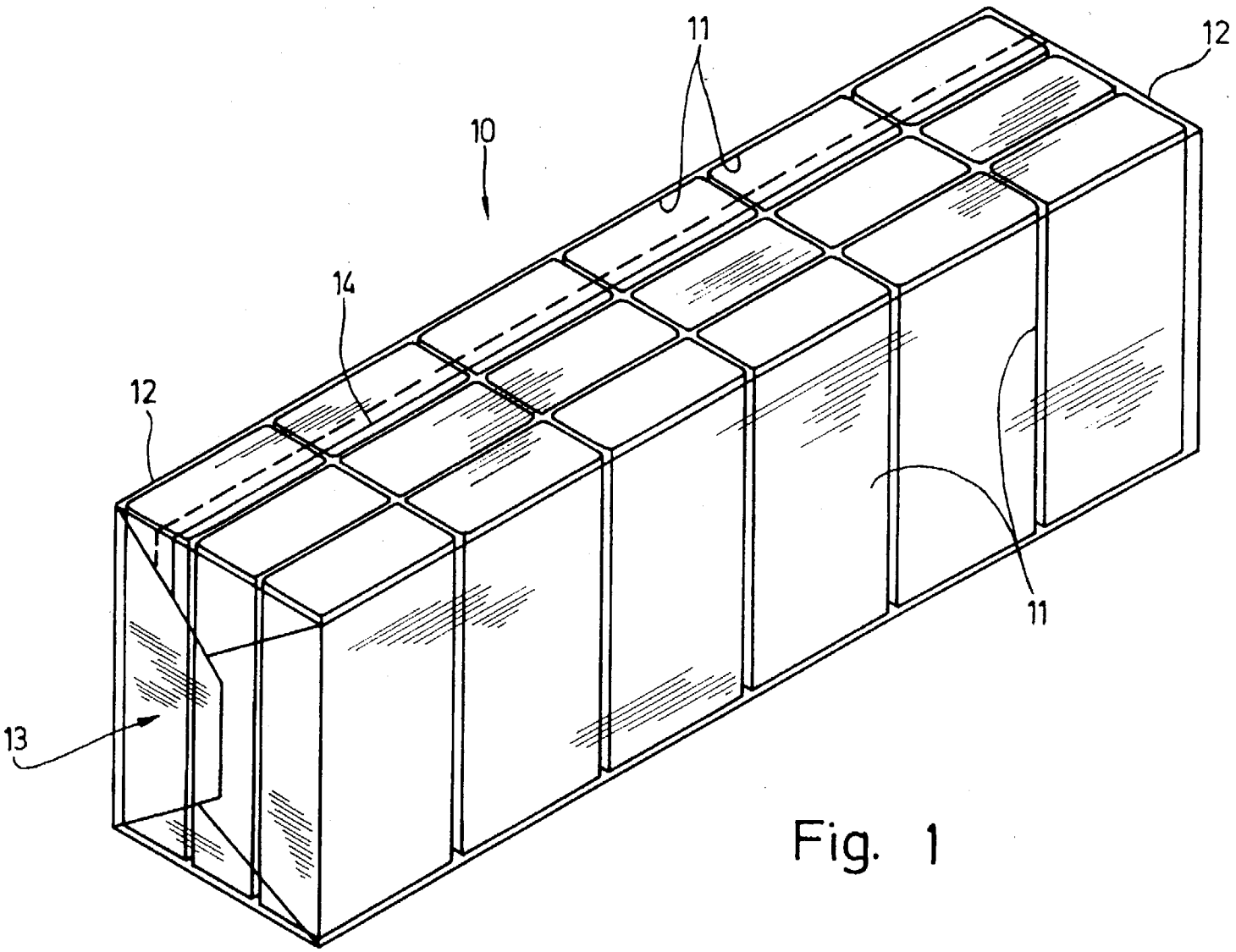
FIG. 1 shows a perspective view of a bundle of small packs of paper tissues.

The drawings relate to the handling of bundles 10 comprising a plurality of cuboid small packs 11. These small packs in their turn consist of groups of folded paper tissues which are surrounded by a foil. A bundle 10 comprises a plurality of small packs 11 arranged next to one another in a plurality of longitudinal and transverse rows. In the present embodiment, a bundle 10 comprises three longitudinal rows of small packs 11.

The bundle 10 is surrounded by a bundle wrapping 12. This bundle wrapping normally consists of a plastic or natural foil, but may also consist of paper. The bundle wrapping 12 is folded such that it entirely surrounds the elongate, cuboidal bundle 10. In the region of the end faces are located envelope-like end foldings 13. A longitudinal seam or closure seam 14 extends on a (top) side. Folding tabs of the end folding 13 and the closure seam 14 are produced by sealing or adhesive bonding but, owing to their structure, without being air-tight. The bundle wrapping 12 itself may be air-permeable.

For the presentation and sale of the bundles 10, they have to be filled into large containers, specifically into a carton 15. In most cases, this carton is set up in the retail store for the presentation of the bundles 10. The consumer withdraws the bundles directly from the carton 15.

Figure 4:
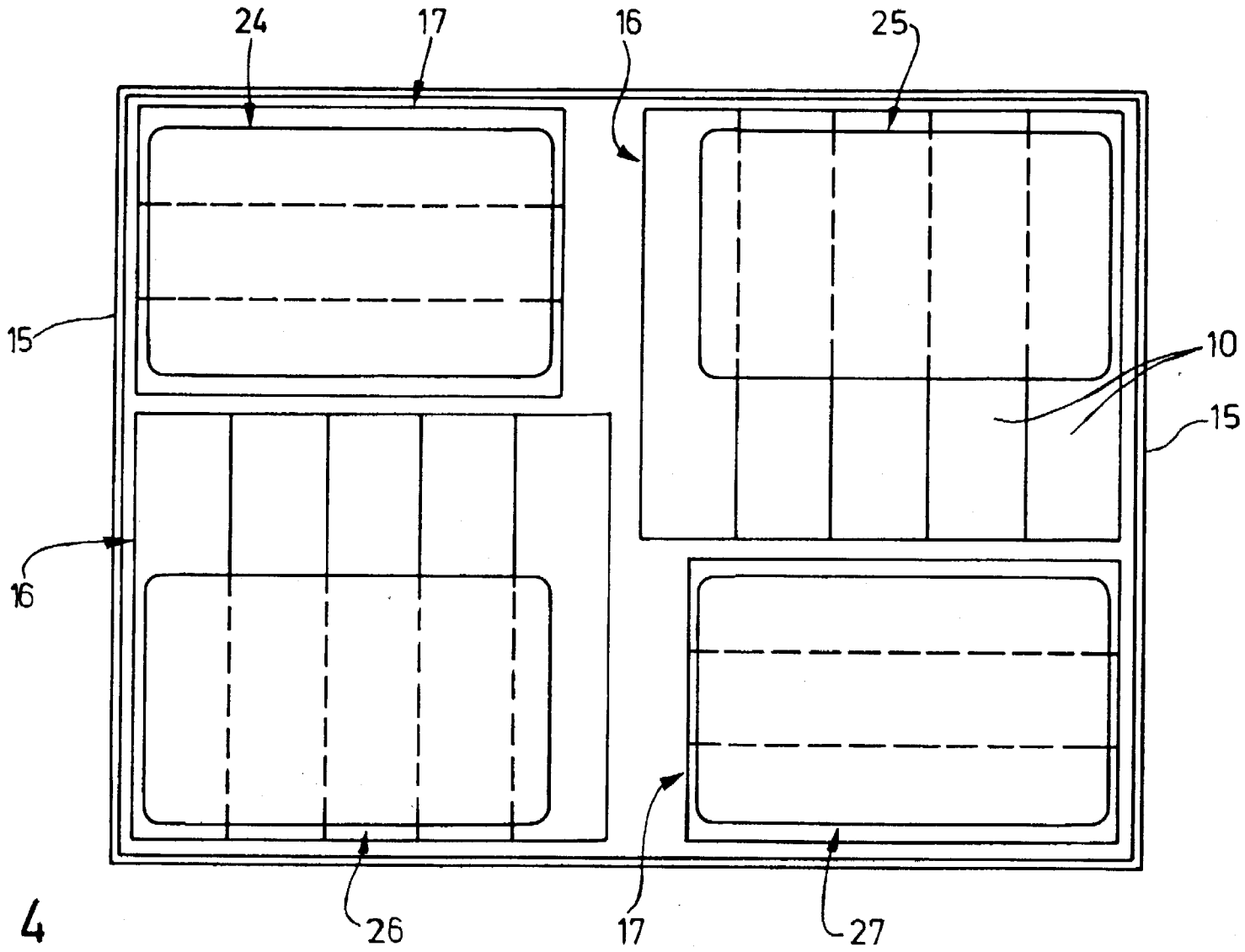
FIG. 4 shows a bottom view of a suction head of a lifting member.
Figure 5:
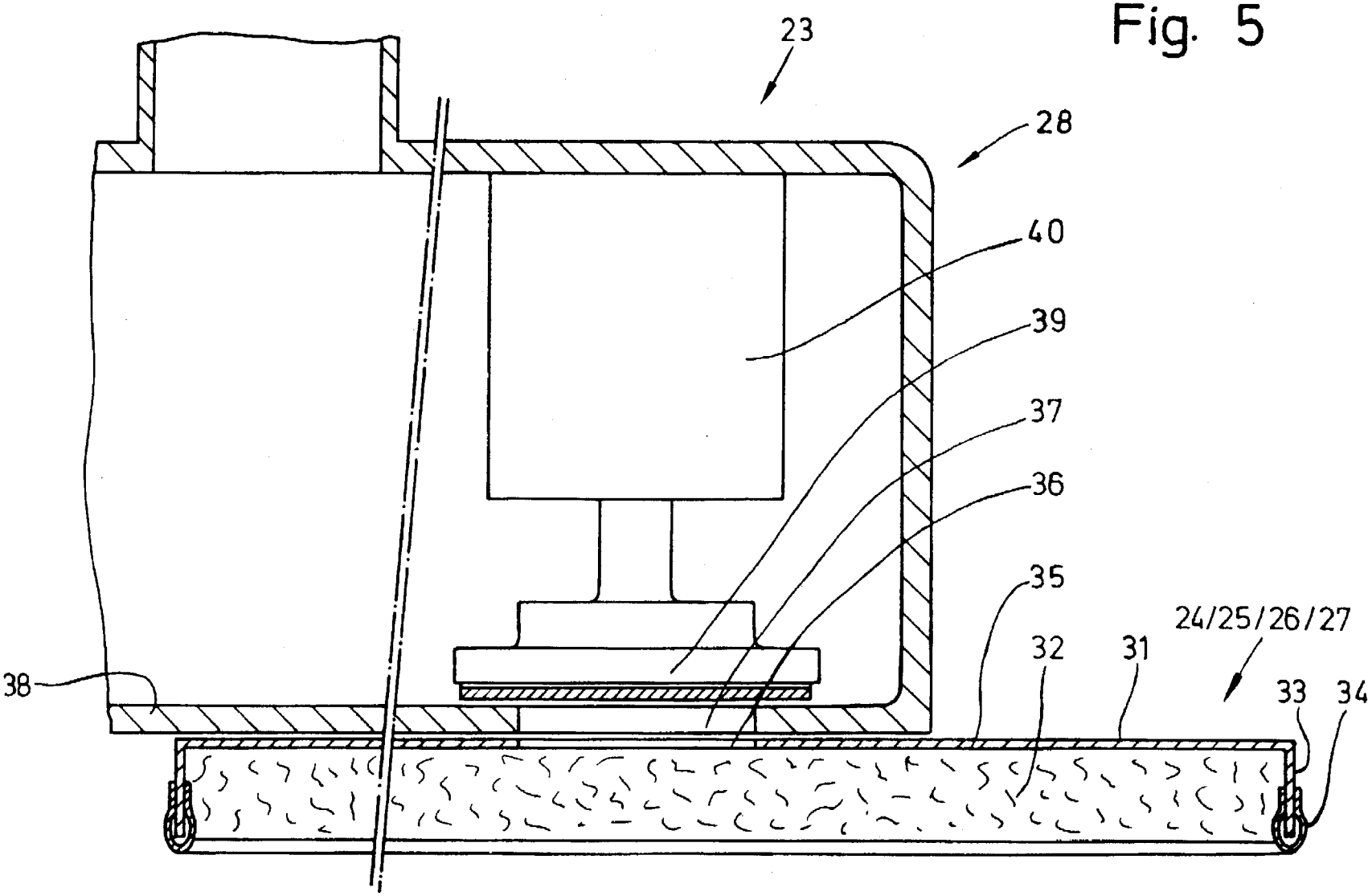
FIG. 5 shows a vertical section of a region of a suction head according to FIG. 40 on an enlarged scale.

The bundles 18 are arranged in layers in the carton 15. Each layer comprises a plurality of bundle groups 16, 17. In the present exemplary embodiment (FIG. 4), one layer comprises four bundle groups 16, 17 of different sizes. Two diametrically opposed bundle groups 16 each comprise 5 adjacent bundles 10. Two equally diametrically opposed smaller bundle groups 17 comprise three adjacent bundles. This formation depends on the predetermined ground plan of the carton 15.

The bundles 10 are filled into the carton 15 by an automatically working apparatus, specifically in layers. A lifting member 18 grasps a unit comprised of two bundle groups 16, 17 of the large and small format (FIG. 4) and conveys them into the carton 15. The bundle groups 16, 17 are grasped in the appropriately aligned position, namely in the formation according to FIG. 4, and conveyed in this manner until they are positioned in the carton 15.

In the apparatus according to the invention, the bundles which are supplied from the bundle packer on a feed conveyor 19, are combined to bundle groups of different sizes in a collecting station 20. In the region of the feed conveyor 19, the bundles 10 are transported with their longitudinal extension directed towards the conveying direction and in a closely-packed position. In the region of the collecting station 20, the bundles 10 are advanced one after another in the transverse direction until a bundle group 16, 17 comprised of several bundles has been formed. The feed conveyor 19 is equipped with a stop member located in front of the collecting station in the conveying direction. The stop member temporarily stops the following strand of bundles 10, while the bundle in the collecting station 20 is moved in the transverse direction.

In the present case the lifting member 18 is configured as a robot with an articulated arm 22. At the free end of this articulated arm 22 is arranged a lifting head 23. This lifting head 23 grasps the bundle groups 16, 17 on their top side. The lifting head 23 is configured such that one complete layer—in the present case four bundle groups 16, 17—can be grasped at the same time.

The bundles 10 or bundle groups 16, 17 are grasped exclusively by suction. For this purpose the lifting head 23 is provided with suction members at its underside. The shown, preferred embodiment is provided with four plate or pillow-like suction holders 24, 25, 26 and 27. Each suction holder serves far grasping and holding an individual bundle group 16, 17 exclusively on the top side of the individual bundles.

The suction holders 24 to 27 are arranged on a support of the lifting head 23, specifically on a common suction box 28. This suction box 28 is connected to the articulated arm via an upright supporting rod 29. A suction line 30 leads from the interior of the suction head 28 to a vacuum source, e.g. to a blower.

Figure 2:
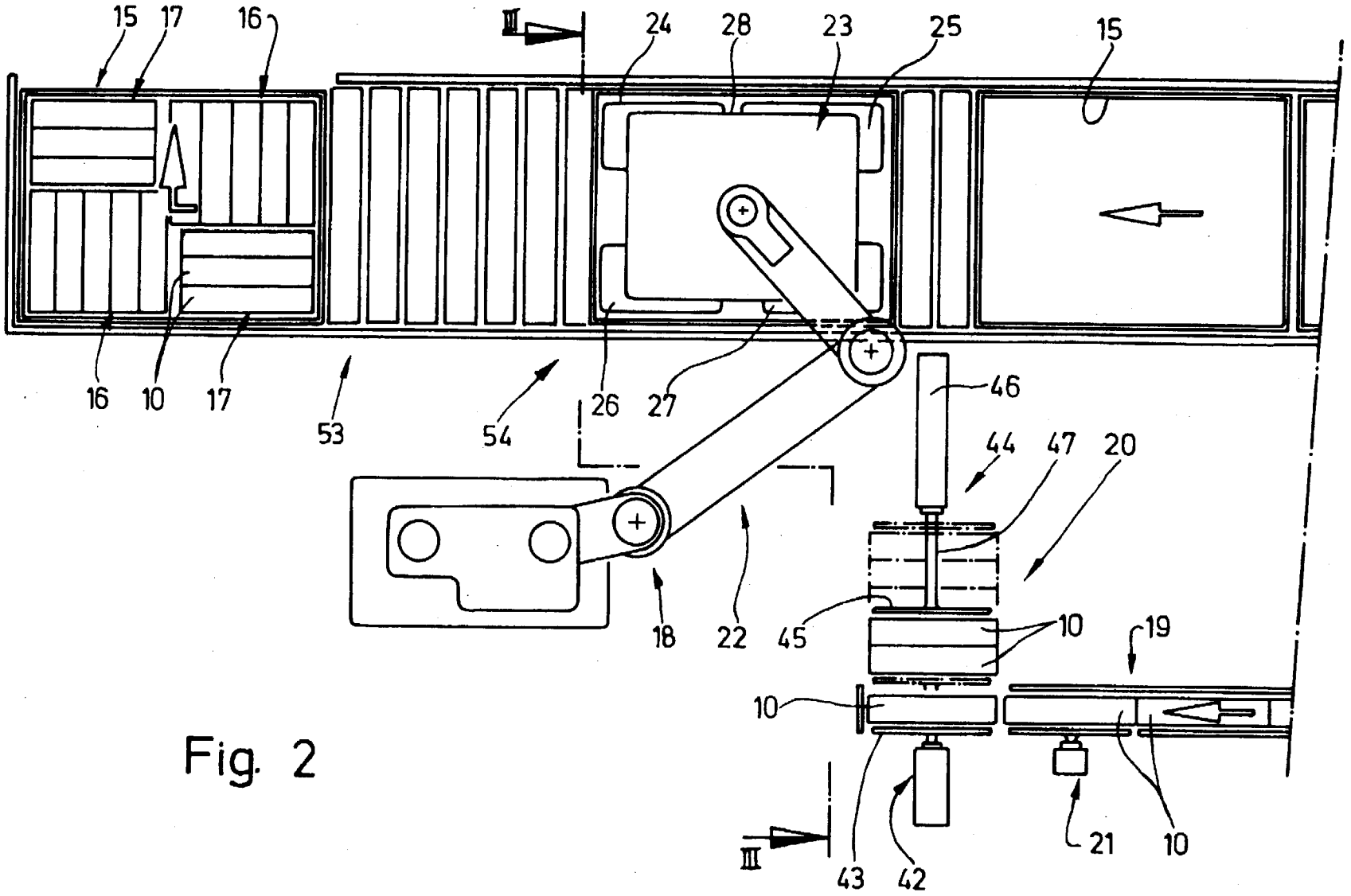
FIG. 2 shows a ground plan of an apparatus for handling such bundles.
Figure 3:
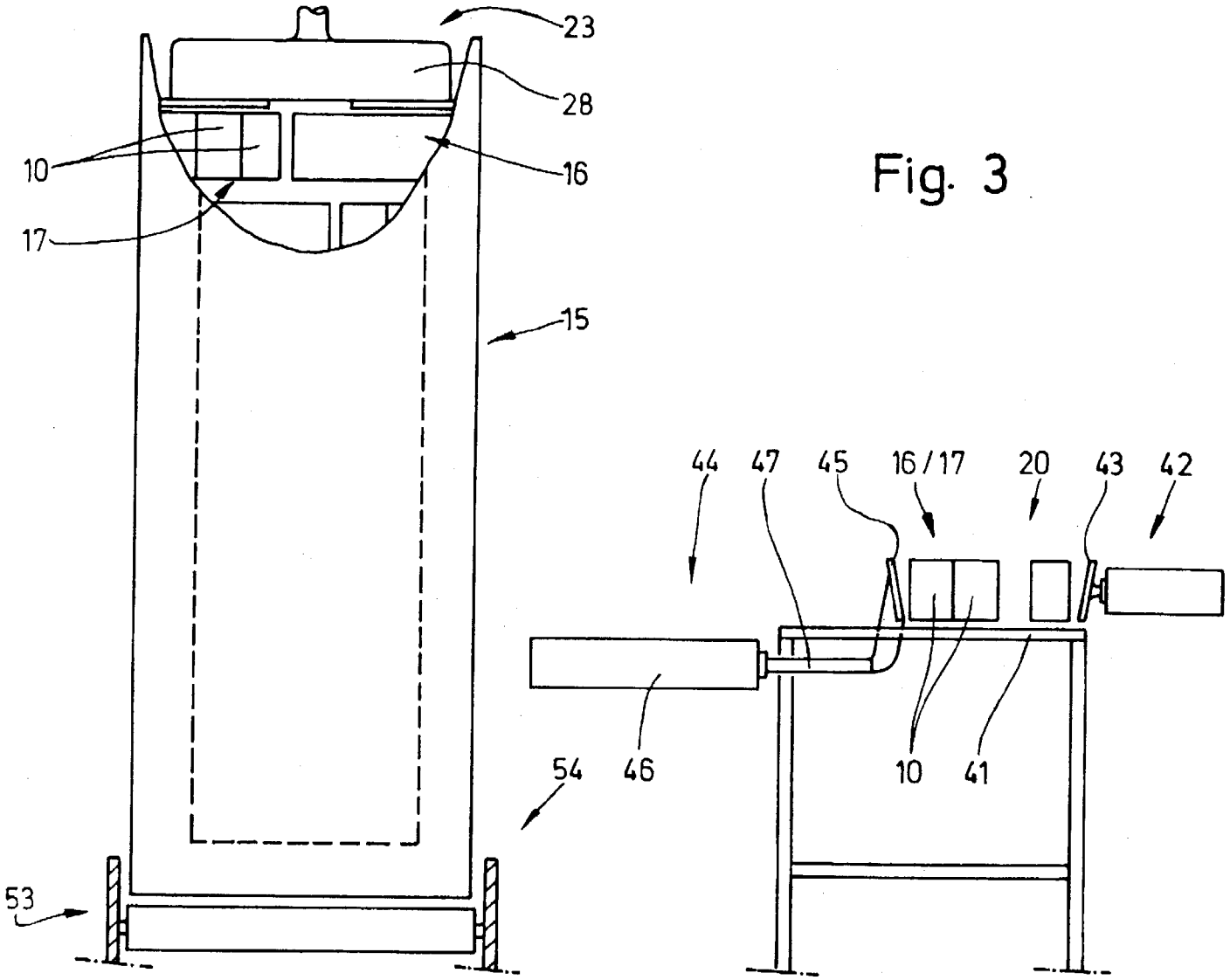
FIG. 3 shows an apparatus according to FIG. 2, in a view or a cross-section taken along sectional plane III—III of FIG. 2.

The rectangular suction holders 24 to 27 are arranged on the corners of the equally rectangular suction box 28 below the same. As is evident especially from FIG. 2, the suction holders 24 to 27 laterally project from the suction box with their outer limitations. The relative position of the suction holders 24 to 27 corresponds exactly to the formation of the bundle groups 16, 17 in a unit of two bundle groups 16, 17 to be handled together.

In the present embodiment, each suction holder 24 to 27 comprises a supporting box 31 which is directed downwards with an open side inside this flat supporting box 31 is arranged a resiliently compressible, air-permeable body 32 which preferably consists of porous and, therefore, air-permeable foam rubber. The articles to be handled, the bundles 10, adjoin this body 32. A circumferential, upright leg 33 of the supporting box 31 is also provided with a circumferential lip 34. The lip consists of a hollow profile and downwardly projects beyond the body 32 and, as a result, sealingly adjoins the top side of the bundle 10.

For the transmission of the vacuum to the supporting box 31 or the body 32, a bottom wall of the supporting box 31 is provided with an opening 36. This opening corresponds to an opening 37 in a lower wall 38 of the suction box 28. The interior of the suction box 28 is entirely subjected to a vacuum.

For handling the bundle groups 16, 17, the suction holders 24 to 27 can be individually subjected to compressed air or deaerated. For this purpose, each suction holder 24 to 27 is assigned a shut-off member. In the present case, a closure plate 39 is situated inside of the suction box 28 above the opening 37. The closure plate 39 can be actuated by means of a pressure medium cylinder 40. The opening 37 is closed by lowering the closure plate 39.

In the collecting station 20, the bundle groups 16, 17 are picked up from a table top 41. The arriving bundles 10 are successively pushed onto the table top 41 by means of a transverse slide 42 until a bundle group 16, 17 of the required size has been formed. This group is then picked up by one of the suction holders 24 to 27.

For combining a complete group as a layer in the carton 15, the lifting head 23 is repeatedly, in the present case four times, lowered on to the table top 41 in order to pick up one bundle group 16, 17 each time. The lifting head 23 is rotated about a vertical axis so that a free suction holder 24 to 27 is always positioned above the bundle group 16, 17.

The plate-shaped suction holders 24 to 27 are of equal size. The dimensions are chosen such that the holding surface of the suction holders 24 to 27 is also covered by small bundle groups 17 which are only comprised of three bundles 10. In large bundle groups 16 the bundles 10 extend with their longitudinal extension transversely to the longitudinal extension of the suction holders 25, 26. Even in this relative position it is ensured that every bundle 10 adjoins the suction holders 25, 26 with sufficient surface.

The collecting station 20 is provided with a mechanical pressure device in order to compress ready-formed bundle groups 16, 17 in the transverse direction. In the present case, the pressure device is comprised of the transverse slide 42 with slide plate 43 on the one side, and a counter slide 44, also with a slide plate 45, on the opposite side. The counter slide 44 is also provided with a pressure medium cylinder 46, which is located below the path of motion of the bundle groups 16 due to a piston rod 47 being bent at a right angle.

The slide plates 43, 45 extend on opposite sides preferably over the entire lateral surface of the outer bundles 10. The slide plates 43, 45 are arranged in a V-shaped relative position and converge downwardly. By moving the slide plates 43, 45 towards one another, the bundles 10 of the bundle group 16, 17 are pressed together and a V-shaped downwardly converging structure is formed. In this shape, the bundle group 16, 17 is picked up by the lifting head 23 or the respective suction holder 24 to 27.

Figure 6:
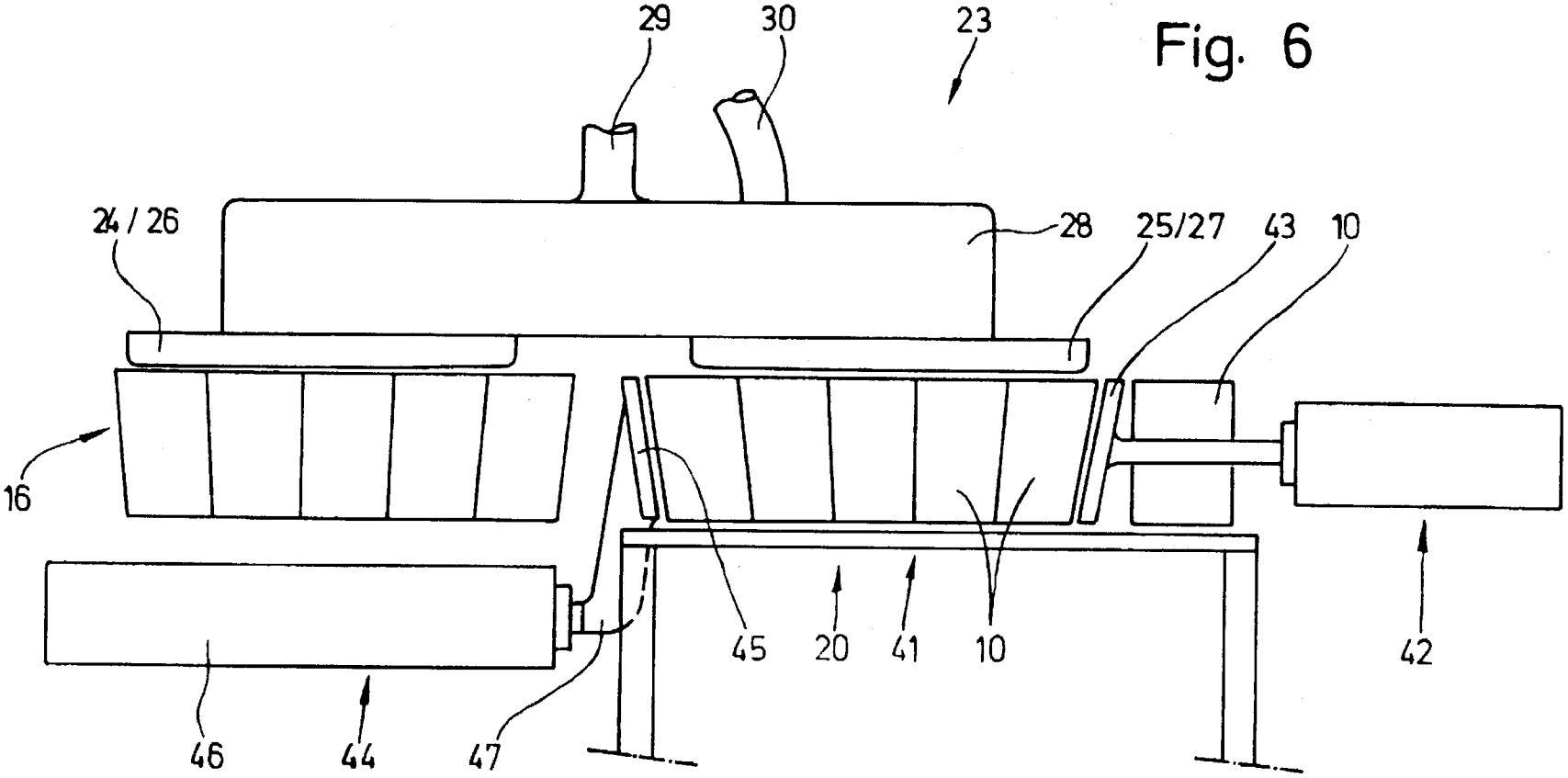
FIG. 6 shows a side view of a pressing station for bundle groups.
Figure 7:
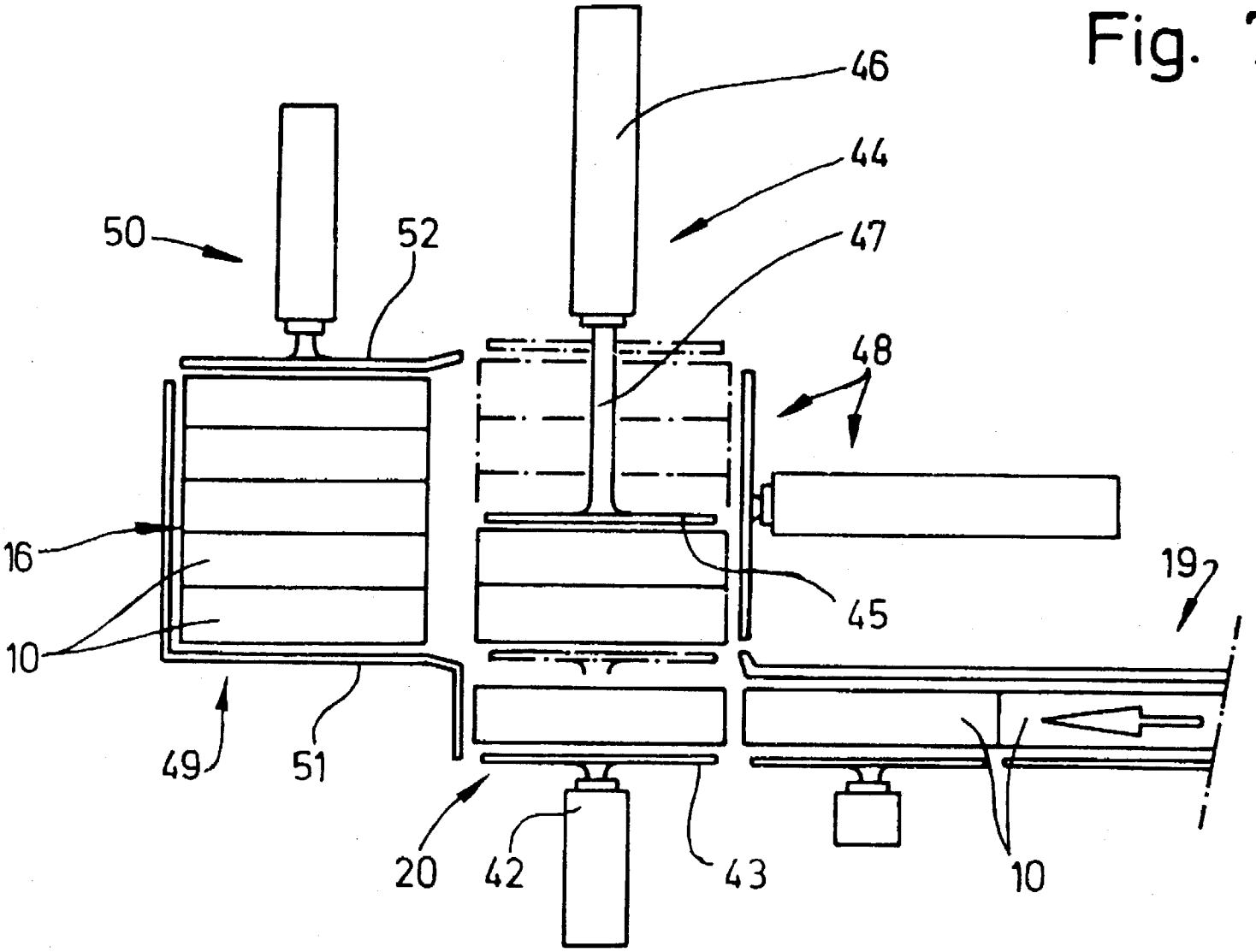
FIG. 7 shows a ground plan of another embodiment of a pressing station for bundle groups.

A ground plan of another embodiment of the collecting station 20 is shown in FIG. 7. In this embodiment, the bundle groups 16, 17 formed on the table top 41 (not visible) are conveyed as a unit into a separate pressing station 49 by a pusher device 48. In this pressing station 49, the respective bundle group 16, 17 rests on a base, e.g. on an extension of the table top 41. A pressure slide 50 acts upon an outer bundle 10 and pushes the bundle group 16, 17 against a stationary stop wall 51 thereby compressing the bundle group 16, 17. As a result, a compression and a reduction of volume of the bundle group 17 is achieved in the same manner as in the embodiment of FIG. 1 or FIG. 6. A pusher plate 5, and the stop wall 51 are also preferably arranged in an inclined manner and thus converging downwardly, analogously to the pusher plates 43 and 45. The ready-formed bundle group 16, 17 is picked Up by the lifting head 23 in the region of the pressing station 49.

The advantage of this embodiment consists in that during the compression and the formation of a ready bundle group 16, 17, and during the picking up by the lifting head 23 in the region of the collecting station 20, the next bundle group can already be formed. This results in a considerable saving of time.

The effectiveness of the apparatus is based on the compressibility and air-permeability of the articles to be handled, specifically bundles 10 and bundle groups 16, 17. In the case of tight foils as bundle wrappings 12, the air-permeability results from the closure seam 14 and the end folding 13 through which the air is removed by suction. The reduction of the volume of the bundles 10 or the bundle groups 16, 17 is effectuated by the suction holders 24 to 27 of the lifting head 23. In the case of mechanical compression of the bundles 10 the air is effectively pressed out of the bundles 10. The suction holders 24 to 27 maintain the compressed shape of they are released in the carton 15. The V-shaped cross-section, which facilitates the lowering of the bundle groups 16, 17 into the carton 15, is also maintained by the suction holder 24 to 25 for the duration of the filling process.

The filling of the carton 15 is fully mechanized in the present case. Empty, upright cartons are fed to filling station 54 an a carton conveyor 53, this filling station 54 is located in the working region of the lifting member 18. After the carton 15 has been filled in layers it is advanced on the carton conveyor 53. The carton 15 is then ready for shipment.

We claim:

1. Process for introducing packs with pack contents made from compressible material into large containers comprising:

(a) providing each pack with a wrapping which completely surrounds the pack contents, each pack having an original volume;

(b) providing the wrapping with an air permeable closure seam in a top side of the pack;

(c) compressing the pack into a compressed shape by mechanical force acting laterally upon mutually opposite sides of the pack, such that air contained in the pack exits at least via the air-permeable closure seam;

(d) contacting the pack in the compressed shape by a lifting member with a suction head so as to subject the compressed pack to subatmospheric pressure;

(e) grasping the pack with the suction head at the top side of each pack, in the region of the closure seam;

(f) releasing the mechanical force after the pack has been grasped by the suction head, wherein the compressed shape of the pack is maintained by continuing to subject each pack at said closure seam to subatmospheric pressure;

(g) conveying the pack to a large container and depositing the pack therein by the lifting member with the pack held in the compressed shape exclusively by the subatmospheric pressure of the suction head without mechanical force compressing the pack and by continuously subjecting said top side to said subatmospheric pressure;

(h) releasing the suction head from the pack and withdrawing subatmospheric pressure from the pack after the pack has been deposited in the large container;

(i) wherein, after the suction head has been released from the pack and thus also after the subatmospheric pressure has been withdrawn, the pack substantially entirely regains said original volume by taking in air.

2. The process as claimed in claim 1, wherein the wrapping is formed from a tight foil and air exits exclusively via the air-permeable closure seam at the top side of each pack.

3. The process as claimed in claim 1, wherein the wrapping is comprised of a tight foil, wherein air-permeable, envelope-like end foldings are formed in the region of end faces of the pack, and wherein, when compressing the pack, air exits the pack in the region of the top side closure seam and the end foldings.

4. The process as claimed in claim 1, wherein the pack, before the transport by the lifting member, is compressed by force at mutually opposite sides of the pack, thereby assuming a downwardly converging formation with a V-shaped cross-section.

5. Apparatus for introducing packs with pack contents of compressible material and with a wrapping made from foil or paper into large containers, the packs being introducible into the large container in layers, each pack having a top side and mutually opposite ends, the wrapping having an air-permeable closure seam at said top side, comprising:

(a) a lifting conveyor with at least one suction member connected thereto, for grasping, transporting and for depositing each pack into the large container;

(b) wherein the suction member grasps the pack at the top side of the pack and subjects the pack to subatmospheric pressure for grasping the pack at said top side;

(c) a compressing station positioned upstream of the lifting conveyor for laterally compressing the packs at mutually opposite ends of the pack;

(d) wherein the compressing station is provided with pressure members which are positioned at the mutually opposite ends of the pack and whereby the pack is laterally compressed to a reduced volume with air escaping the pack;

(e) wherein the pressure members are plate-shaped, and selected from the group consisting of slide plates and a stop wall with sliding plate, the pressure members being arranged in a downwardly converging oblique V-position;

(f) control means for gasping the pack by the suction member at said top side in the region of the closure seam, after the pack is compressed and subjecting it to subatmospheric pressure;

(g) control means for releasing the pressure members after the pack has been grasped by the suction member, and (h) control means for conveying the compressed pack into the large container and depositing said pack therein by the lifting conveyor while the subatmospheric pressure and the reduced volume are maintained.

6. The apparatus as claimed in claim 5, wherein said articles are selected from the group consisting of bundles and bundle groups.

7. The apparatus as claimed in claim 5, wherein said articles are comprised of cellulose.

8. The apparatus as claimed in claim 5, wherein said articles comprise groups of packs with paper tissues, each group of packs having one complete wrapping made of a material selected from the group consisting of foil and paper, wherein said wrapping is provided with an upwardly-directed, air-permeable closure seam.

9. The apparatus as claimed in claim 6, wherein each bundle or bundle group is surrounded with a wrapper, and wherein said wrapper has an upwardly-directed, air-permeable closure seam capable of being grasped by the suction member.

10. The apparatus as claimed in claim 6, wherein the lifting member is provided with a lifting head having a plurality of individually-controllable suction holders, each suction holder for grasping a bundle or a bundle group.

11. The apparatus as claimed in claim 10, wherein four suction holders having a rectangular arrangement are positioned on an underside of a common suction box of said lifting member, the amount of suction applied to each suction holding being individually controllable.

12. The apparatus as claimed in claim 10, wherein each suction holder is provided with a plate-shaped flat body formed of resilient, air-permeable material, for adjoining the bundles or bundle groups to the section holders.

13. The apparatus as claimed in claim 12, wherein said resilient, air-permeable material is porous foam rubber.

* * * * *